US005143439A

United States Patent [19]

Lewis et al.

[11] Patent Number: 5,143,439

[45] Date of Patent: Sep. 1, 1992

[54] HIGH EFFICIENCY NOVELTY FLASHER ASSEMBLY

[75] Inventors: Edward D. Lewis, Speedway; Timothy D. Hogue, Indianapolis, both of Ind.

[73] Assignee: Buztronics, Inc., Indianapolis, Ind.

[21] Appl. No.: 735,665

[22] Filed: Jul. 26, 1991

Related U.S. Application Data

[63] Continuation of Ser. No. 516,537, Apr. 30, 1990, abandoned.

[51] Int. Cl.[5] ..... F21L 2/08

[52] U.S. Cl. ..... 362/103; 362/191; 362/394; 362/800; 362/806

[58] Field of Search ..... 362/103, 104, 191, 253, 362/294, 394, 396, 800, 806, 234; 40/315, 1.5; 200/60; 63/1.1, 20

[56] References Cited

U.S. PATENT DOCUMENTS 3,805,047 4/1974 Dockstader ..... 362/104

4,215,388 7/1980 Reimann ..... 362/104

4,719,544 1/1988 Smith ..... 362/104

*Primary Examiner*—Stephen F. Husar

*Attorney, Agent, or Firm*—Willian Brinks Olds Hofer Gilson & Lione

[57] ABSTRACT

A novelty button assembly provides buttons with a variety of indicia on the face of the button and an unlimited location of the blinking light in the face of the button. An electronic circuit is adapted to drive a light emitting diode with a current pulse of very short duration to permit the use of a small battery and to provide long battery life. A capacitor is used in a novel high efficiency oscillator circuit only in the determination of blinking rate and battery current duty cycle, allowing the use of a wide variety of smaller value capacitors that lend themselves to microelectronic packaging desirable in flasher button assemblies. The pin used to fasten the flasher button assembly to the clothing of a wearer also serves as the electrical switch to turn the flashing button assembly on and off.

15 Claims, 1 Drawing Sheet

HIGH EFFICIENCY NOVELTY FLASHER ASSEMBLY

This application is a continuation of application Ser. No. 07/515,537, filed Apr. 30, 1990, now abandoned.

FIELD OF THE INVENTION

This invention relates to novelty buttons including blinking lights, and relates more particularly to a novelty button assembly adaptable for use with the variety of indicia and blinking light locations, and still more particularly relates to a high efficiency microelectronic light emitting diode flasher assembly adapted to provide shortened duty cycles to conserve battery power.

BACKGROUND ART

Electronic blinking novelty items have been available for a number of years to suit many applications such as decorations, advertising signs and other attention-getting devices. Such electronic blinking novelty items have used both digital and analog oscillating circuitry. However, such prior novelty items have been made with little regard for the duty cycle of battery or power sources and seemingly little desire to conserve battery life. The oscillating circuitry of most prior novelty items have been inefficient and have required large batteries to obtain long lives. The oscillators used in these prior devices have employed large and costly charge-pump type capacitors to provide a supplemental current pulse source and a pulse-timing component and have frequently required a separate switch component to operate the circuit.

Among the prior patents disclosing such prior oscillating circuits are U.S. Pat. Nos. 3,805,047; 3,866,035; 3,918,184; 4,076,978; 2,815,388; 4,459,645; 4,556,932; 4,634,148; and 4,719,544.

DISCLOSURE OF THE INVENTION

This invention provides a novelty button assembly that may be adapted to provide buttons with a variety of indicia on the face of the button and an unlimited location of the blinking light in the face of the button. Furthermore, the invention overcomes the problems of prior blinking light novelty items through an electronic circuit adapted to drive a light emitting diode with a current pulse of very short duration to permit the use of a small battery and to provide a battery life unparalled by prior devices. In the invention, a capacitor is used in high efficiency oscillator circuit only in the determination of blinking rate and battery current duty cycle, allowing the use of a wide variety of smaller value capacitors that lend themselves to microelectronic packaging desirable in flasher button assemblies. In addition, in the invention the pin used to fasten the flasher button assembly to the clothing of a wearer also serves as the electrical switch to turn the flashing button assembly on and off.

Novelty button assemblies of this invention therefore include a front plate adapted to bear an indicia on its face and to provide an opening to receive a light emitting diode at any location coordinated with the indicia, and an electronic assembly comprising a printed circuit board bearing an electronic flasher circuit and including a light emitting diode connected to the electronic flasher circuit on the printed circuit board by flexible conducting means. The flexible conducting means permit the location of the light emitting diode at any location in the front face of the button, and the front plate is adapted to be removably fastened to the printed circuit board and to hold the light emitting diode in the front plate opening when fastened to the printed circuit board. Because of its short duty cycle, the electronic flasher circuit includes a small battery to power the electronic flasher circuit and the light emitting diode. The printed circuit board carries a pin including a pin portion and a hook portion to fasten the novelty button to a wearer's clothes. The pin portion and hook portion are separately connected between the electronic flashing circuit and the battery and light emitting diode so that when the novelty button assembly is fastened to the clothing of a wearer and the pin is closed the engagement of the pin and hook portions act as a switch closing the circuit between the battery and the electronic flashing circuit and light emitting diode to operate the blinking novelty button. When the pin is removed from the clothing of the wearer and left open, it interrupts power to the flashing circuit and light emitting diode thereby conserving battery power when the novelty button assembly is not in use.

The preferred electronic flashing circuit of the invention comprises a switching transistor serially connected with a small current limiting resistance between the battery and the light emitting diode. The switching transistor is controlled by a transistor control network, including a control transistor, which is serially connected between the base-to-emitter junction of the switching transistor and the battery, and a resistor-capacitor network. The resistor-capacitor network includes a high resistance connected with the battery, with the base of the control transistor and with a capacitor. The high resistance substantially determines the rate of charging of the capacitor by the battery and so isolates the base of the control transistor from the battery that the voltage of the capacitor effectively determines the voltage at the base of the control transistor and the flow of current through the control transistor and through the switching transistor. The resistor-capacitor network further includes a smaller resistor to control the discharge current from the capacitor through the control transistor and light emitting diode, to ensure bright emission from the light emitting diode with a minimum conduction time of the switching transistor, thereby providing a short duty cycle that is effective to conserve battery power.

Other features and advantages of the invention will be apparent from the drawings and descriptions that follow.

BEST MODE OF THE INVENTION

Figure 1:
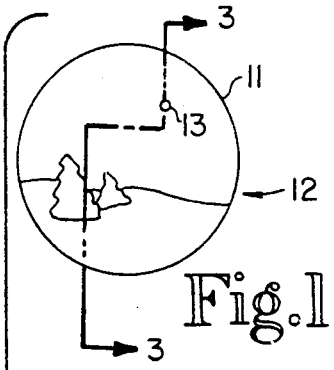
FIG. 1 is a drawing of the face plate of a typical novelty button of the invention.

FIGS. 1–4 show a novelty button 10 of this invention. FIG. 1 shows a front plate 11 adapted to bear indicia 12 on its face. Front plate 11 is also adapted to provide an opening 13 to receive a light emitting diode. Although FIG. 1 shows the front plate having a simplified indicia depicting a winter scene with an opening positioned to simulate a blinking star, it is apparent that front plate 11 may be provided with any indicia, slogan, trademark or advertising.

Figure 2:
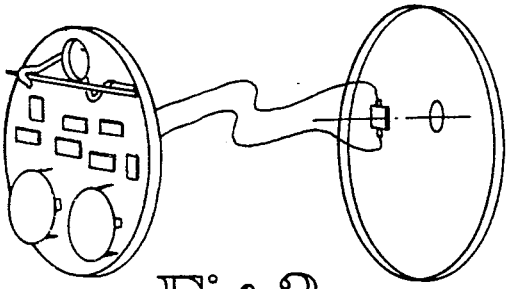
FIG. 2 is a perspective view of a novelty button assembly of the invention.
Figure 3:
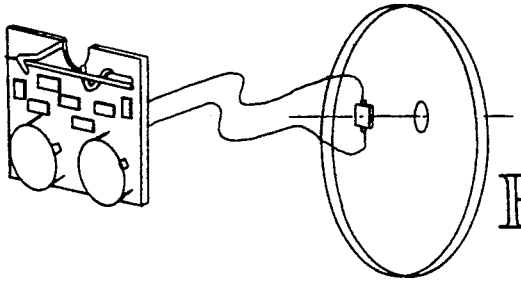
FIG. 3 is a perspective view of another embodiment of a novelty button assembly of the invention.

FIGS. 2 and 3 are perspective drawings of an electronic assembly 20 of the invention. FIG. 3 shows the assembly 20 with a rectangular printed circuit board 21, which is preferred. The electronic assembly 20 of FIG. 2 is adapted to be removably fastened to the front plate 11 of FIG. 1, as indicated in FIGS. 2 and 3. Electronic assembly 20 includes a printed circuit board 21 bearing an electronic flasher circuit including the components shown on the schematic diagram of FIG. 4. As shown in FIGS. 2 and 3, a light emitting diode 22 is connected with the electronic flasher circuit on printed circuit board 21 by flexible conducting means 23. Flexible conducting means 23 has sufficient length that the light emitting diode 22 can be located at any location in the surface of front plate 11. As is shown in FIGS. 2 and 3, in assembly of the novelty button, light emitting diode 22 may be placed in opening 13 and will be held within opening 13 when printed circuit board 21 is fastened to front plate 11. Printed circuit board 21 is preferably fastened to front plate 11 by adhesive material, or glue, but may be fastened by any convenient means.

Figure 4:
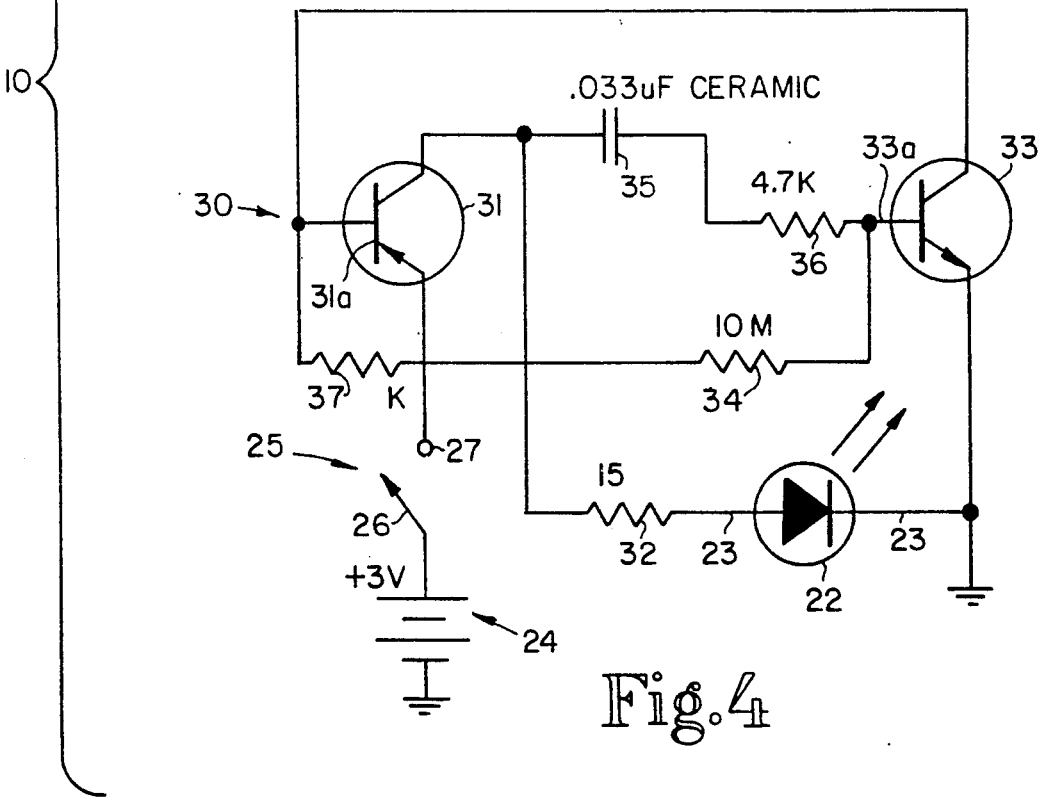
FIG. 4 is a circuit diagram of the electronic assembly of FIG. 2.

FIGS. 2–4 show another feature of the invention. The electronic assembly 20 further comprises one or more batteries 24 to power the electronic flasher circuit and the light emitting diode 22. The printed circuit board 21 carries a pin 25 to fasten novelty button to a person's clothing. Pin 25 includes two separate portions that are fastened to circuit board 21 and interconnected into the electronic flasher circuit. Pin 25 includes pin portion 26 and a hook portion 27 that are structurally fastened to the printed circuit board 21, for example by soldering, and interconnected to the electronic flasher circuit as shown in FIG. 4. As shown in FIG. 4, pin portion 26 is connected with one terminal of battery 24 and hook portion 27 is connected with the remainder of electronic flasher circuit 30. When pin portion 26 is engaged with hook portion 27, for example, when the button is fastened to the clothes of a user, the pin-switch 25 is closed providing power from battery 24 to flasher circuit 30 and light emitting diode 22. When pin 25 is open and pin portion 26 does not engage hook portion 27, the pin-switch 25 is open, as shown in FIG. 4, and interrupts power from the battery to the flasher circuit and light emitting diode, conserving battery power.

A preferred electronic flasher circuit 30 is shown in schematic diagram of FIG. 4. The exact manner in which flasher circuit 30 operates is not entirely understood and the explanation that follows represents the inventors' best explanation for the surprising and unique operation of their invention.

The components shown in the schematic diagram of FIG. 4 are carried on the printed circuit board 21 in a manner well known to those skilled in the art. The preferred electronic flasher circuit of FIG. 4 includes a switching transistor 31 serially connected with a small current limiting resistor 32 between battery 24 and light emitting diode 22. In the preferred circuit of FIG. 4, the switching transistor is a Motorola MMBT 3906T and the small current limited resistor 32 has a value of 18 ohms. The electronic flasher circuit 30 further includes a control transistor 33, which is a Motorola MMBT 3904T transistor. Control transistor 32 is serially connected between the base-to-emitter junction 31*a* of switching transistor 31 and 24. The base 33*a* of control transistor 33 is connected with a resistor-capacitor network including a high resistance 34 that is connected with the battery 24, with the timing capacitor 35 and with the base 33*a* of control transistor 33. High resistance 34, which is, for example, 10 megohms, substantially determines the rate of charging of timing capacitor 35 by the battery 24 through a path including battery 24, high resistance 34, a smaller resistor 36, capacitor 35, resistor 32 and light emitting diode 22. The resistances of resistors 32 and 36 are very small compared to the high resistance 34 and have a negligible effect upon the charging rate of capacitor 35 by battery 24. High resistance 34 also isolates the base 33*a* of control transistor 33 from battery 24 so that the voltage on capacitor 35 effectively determines the voltage at the base 33*a* of control resistor 33 and, therefore, the flow of current through control transistor 33 and switching transistor 31. As noted above, the resistor-capacitor network includes a smaller resistor 36 which effectively controls the discharged current from capacitor 35 through a path including control transistor 33, resistor 36, capacitor 35, resistor 32 and light emitting diode 22. The smaller resistor 36 has 4,700 ohms of resistance and thus provides a very short discharge time for capacitor 35 and short conduction times for transistors 31 and 33, thereby providing a bright emission from light emitting diode 22 with a minimum of conduction time of switching transistor 31 and providing a duty cycle that is effective at conserving battery power.

Thus, FIG. 4 illustrates a preferred electronic circuit for use with the novelty item of this invention. The switching transistor 31 is connected in parallel circuit arrangement across a voltage source 24. Light emitting diode 22 is in series with a current limiting resistor 32 and is interconnected between the collector of transistor 31 and the voltage source 24. The emitter of transistor 31 is connected to switch 25. The base of transistor 31 is coupled to the collector of the transistor 33 and includes a current limiting resistor 37 connected to voltage source 24. A regenerative feedback loop including resistor 36 and capacitor 35 is interconnected between the collector of switching transistor 31 and the base of control transistor 33. The collector of control transistor 33 is connected to the voltage source 24 through current limiting resistor 37.

With the switch initially open, switching transistor 31 and control transistor 33 are biased off and the light emitting diode is not energized. When switch 25 is closed, current begins to flow through high resistance 34 to the base 33*a* of the control transistor 33, the resistor 36 and charging capacitor 35. Capacitor 35 slowly charges through resistors 32, 34 and 36 and light emitting diode 22. In the charging time, which is determined substantially by the values of capacitor 35 and resistance 34, the accumulated voltage of capacitor 35 will drive control transistor 33 to conduction. The saturation current of control transistor 33 through the emitter-to-base junction of switching transistor 31, drives switching transistor 31 into conduction. With the switching transistor 31 in the saturated state, current flows from capacitor 35 through resistor 32 and 36 and through light emitting diode 22. The current draw of switching transistor 31 energized the light emitting diode 22. Timing capacitor 35 is discharged at a rate determined by resistor 36, which is very short (e.g., about 0.15 millisecond) compared with the charging time of capacitor 35 (e.g., about 0.33 seconds). When timing capacitor 35 is completely discharged, control transistor 33 no longer has an appropriate voltage potential at its base 33*a* and collector current is cut off. As collector current of control transistor 33 is cut off, the current supplied to the base of the switching transistor 31 is reduced sufficiently so that it will no longer be in saturation. At this time, the voltage to the light emitting diode 22 quickly drops, turning the light off, and the control capacitor 35 is then able to begin charging again and the cycle is repeated. This charging process is comparatively long due to the high resistance of resistor 34 in the charging current path.

Although the circuit shown in FIG. 4 utilizes a PNP transistor for the switching transistor 31, and a NPN transistor for control transistor 33, it is understood that these transistors could be reversed with a corresponding reversal of the voltage source, as it known in the art. The power ratings and resistor tolerances are not critical. As one skilled in the art will note, the preferred circuit of FIG. 4 does not require a large electrolytic capacitor, but permits smaller, less expensive and more reliable capacitors to be used.

While what has been described constitutes a presently most preferred embodiment, the invention can take many other forms. Accordingly, it should be understood that the invention is to be limited only insofar as is required by the scope of the following claims.

We claim:

1. A novelty button assembly, comprising:

a front plate adapted to bear an indicia on its face and to provide an opening to receive a light emitting diode at any location coordinated with the indicia on its face;

an electronic assembly comprising a printed circuit board bearing an electronic flasher circuit including a light emitting diode connected to the electronic flasher circuit on said printed circuit board by flexibel conducting means, said flexible conducting means permitting the location of the light emitting diode at any location in said front plate, said light emitting diode and said front plate being adapted to hold said light emitting diode in said opening when said front plate is fastened to said printed circuit board;

said electronic flasher circuit comprising a switching transistor serially connected with a small current limiting resistance between a battery and said light emitting diode, a switching transistor control network including a control transistor serially connected between the emitter to base junction of the switching transistor and said battery, and a resistor-capacitor network comprising a high resistance connected with said battery, with a capacitor and with the base of said control transistor, said high resistance substantially determining the rate of charging of sad capacitor by said battery, and so isolating the base of said control transistor and light emitting diode to ensure a bright emission from said light emitting diode with a minimal conduction time of said switching transistor, thereby providing a duty cycle that is effective in conserving battery power.

2. A novelty button assembly comprising:

a face plate adapted to display a light emitting source; and an electronic assembly comprising a battery, a light emitting source and an electronic flasher circuit for said light emitting source, said electronic assembly being adapted to be fastened behind said face plate so that said light emitting source is displayed by said face plate;

said electronic assembly further including a pin to hold said novelty button on the clothes of a user, said pin including a pin portion and a hook portion which are separate, said pin portion and said hook portion each being structurally connected to said electronic assembly and electrically connected with said battery, said light emitting source and said electronic flasher circuit so that the mechanical engagement of said pin portion with said hook portion to fasten the novelty button on the clothes of a user switches power from said battery to said electronic flasher circuit and light emitting source to periodically operate said light emitting source, the disengagement of said pin portion and hook portion electrically disconnecting said battery from said electronic flasher circuit and said light emitting source;

said electronic flasher circuit comprising no more than four resistors, two transistors, one LED light and one capacitor, said transistors are of the NPN and PNP variety with some degree of leakage current and said capacitor has a value no greater than 0.047 uF.

3. The novelty button of claim 2 wherein said capacitor is of the ceramic variety and said capacitor solely provides a timing function in said electronic flasher circuit.

4. The novelty button of claim 2 wherein said electronic flasher circuit is configured and arranged in a manner to provide an oscillating pulse causing the LED light to flash in a periodic manner when the electronic flasher circuit is energized, with a current pulse width no greater than one percent of the period for one cycle.

5. The novelty button of claim 2 wherein said light emitting source comprises a light emitting diode.

6. The novelty button of claim 2 wherein said pin comprises a standard metallic badge crimp pin, said crimp pin being located on a printed circuit board on side opposite of said face plate.

7. The novelty button of claim 5 wherein said battery source is three volts providing sufficient voltage to flash said light emitting diode without the use of charge pump circuitry, wherein said battery source comprises two button cell batteries inserted in mounting brackets attached to a printed circuit mounting board, wherein said mounting brackets contact a pole of a battery inserted in said novelty button and wherein said mounting brackets are configured to allow removal of batteries along the surface of said mounting board for replacement.

8. A novelty button assembly comprising:

a face plate adapted to display a light emitting diode;

an electronic flasher circuit comprising a switching transistor serially connected with a small current limiting resistance between a battery and said light emitting diode; and a switching transistor control network including a control transistor serially connected between the emitter to base junction of the switching transistor and said battery, and a resistor-capacitor network comprising a high resistance connected with said battery, with a capacitor and with the base of said control transistor, said high resistance substantially determining the rate of charging of said capacitor by said battery, and so isolating the base of said control transistor from said battery that the voltage of capacitor effectively determines the voltage at the base of said control transistor and the flow of current through said control transistor and said switching transistor, said resistor-capacitor network further comprising a smaller resistor to control the discharge current from said capacitor through said control transistor and light emitting diode to ensure a bright emission from said light emitting diode with a minimal conduction time of said switching transistor, thereby providing a duty cycle that is effective in conserving battery power.

9. The novelty button assembly of claim 8 wherein said electronic flasher circuit includes a printed circuit board and a pin carried by said printed circuit board to fasten said novelty button to a person's clothes, said pin including a separate hook portion and a separate pin portion adapted to engage mechanically said hook portion, said pin portion and said hook portion being electrically connected between said electronic flasher circuit and said battery to provide a switch to power the flasher circuit and light emitting diode a switch to power the flasher circuit and light emitting diode when said pin is closed and said pin portion engages mechanically said hook portion and to interrupt power to said flasher circuit and light emitting diode when said pin mechanically said hook portion.

10. The novelty button of claim 8 wherein said electronic flasher circuit comprises not more than four resistors, two transistors, one LED light and one capacitor, said transistors are of the NPN and PNP variety with some degree of leakage current and said capacitor has a value no greater than 0.047 uF.

11. The novelty button of claim 8 wherein said capacitor is of the ceramic variety and said capacitor solely provides a timing function in said electronic flasher circuit.

12. The novelty button of claim 8 wherein said electronic flasher circuit is configured and arranged in a manner to provide an oscillating pulse causing the LED light to flash in a periodic manner when the electronic flasher circuit is energized with a current pulse width no greater than one percent of the period for one cycle.

13. The novelty button of claim 8 wherein said battery source is three volts providing sufficient voltage to flash said light emitting diode without the use of charge pump circuitry, wherein said battery source comprises two button cell batteries inserted in mounting brackets attached to a printed circuit mounting board, wherein said mounting brackets contact a pole of a battery inserted in said novelty button and wherein said mounting brackets are configured to allow removal of batteries along the surface of said mounting board for replacement.

14. A novelty button assembly comprising:

a face plate adapted to display a light emitting source; and an electronic assembly comprising a circuit board, a battery and a light emitting source, said electronic assembly being adapted to be fastened behind said face plate so that said light emitting source is displayed by said face plate;

said electronic assembly further comprising a pin having separate electrically engageable pin and hook portions fastened to the circuit board, said pin and hook portions each being structurally and electrically connected to said circuit board so that mechanical engagement of said pin portion with said hook portion carries the novelty button and operates said light emitting source.

15. A novelty button assembly comprising:

a face plate adapted to display a light emitting source; and an electronic assembly comprising a circuit board, a battery, a light-emitting source connected to said assembly by flexible conducting means, and an electronic flasher circuit for said light emitting source carried by said circuit board, said circuit board being adapted to be fastened behind said face plate, said light emitting source being displayable at any location is said face plate;

said electronic assembly further including a pin electrically and mechanically connected to said circuit board, said pin including a pin portion and a hook portion which are separate, said pin portion and said hook portion each being structurally connected to said circuit board and electrically connected with said battery, said light emitting source and said electronic flasher circuit so that the mechanical engagement of said pin portion with said hook portion fastens the novelty button on the clothes of a user and switches power from said battery to said electronic flasher circuit and light emitting source to periodically operate said emitting source, and disengagement of said pin portion and hook portion electrically disconnects said battery from said electronic flasher circuit and said light emitting source and permits removal of said novelty button.

* * * * *

UNITED STATES PATENT AND TRADEMARK OFFICE

CERTIFICATE OF CORRECTION

PATENT NO. : 5,143,439

DATED : September 1, 1992

INVENTOR(S) : Edward D. Lewis, et al.

It is certified that error appears in the above-identified patent and that said Letters Patent is hereby corrected as shown below:

In col. 3, line 67, after "and", insert --the battery--.

In Col. 5, line 37, delete "flexibel" and insert therefor --flexible--.

In Col. 5, line 55, delete "sad" and insert therefor --said--.

In Col. 7, line 21, delete "a switch to".

In Col. 7, line 22, delete "power the flasher circuit and light emitting diode".

In Col. 7, line 25, after "pin", insert --is open and said pin portion does not engage--.

UNITED STATES PATENT AND TRADEMARK OFFICE

CERTIFICATE OF CORRECTION

PATENT NO. : 5,143,439

DATED : September 1, 1992

INVENTOR(S) : Edward D. Lewis, et al

It is certified that error appears in the above-indentified patent and that said Letters Patent is hereby corrected as shown below:

In Col. 7, line 28, delete "not" and insert therefor --no--.

In Col. 8, line 31, delete "is" and insert therefor --in--.

Signed and Sealed this

Fourteenth Day of September, 1993

Bruce Lehman

*Attest:*

BRUCE LEHMAN

*Attesting Officer*

*Commissioner of Patents and Trademarks*